US007222484B1

(12) United States Patent
Dornbach

(10) Patent No.: US 7,222,484 B1
(45) Date of Patent: May 29, 2007

(54) HYDRAULIC SYSTEM WITH MULTIPLE PRESSURE RELIEF LEVELS

(75) Inventor: David A. Dornbach, Waukesha, WI (US)

(73) Assignee: Husco International, Inc., Waukesha, WI (US)

( * ) Notice: Subject to any disclaimer, the term of this patent is extended or adjusted under 35 U.S.C. 154(b) by 0 days.

(21) Appl. No.: 11/367,853

(22) Filed: Mar. 3, 2006

(51) Int. Cl.
*F15B 11/16* (2006.01)
*F15B 11/00* (2006.01)

(52) U.S. Cl. ..... 60/422; 60/484

(58) Field of Classification Search ..... 60/420, 60/422, 484, 468
See application file for complete search history.

(56) References Cited

U.S. PATENT DOCUMENTS 4,561,463 A 12/1985 Brownbill et al.
4,986,071 A * 1/1991 Voss et al. ..... 60/420
5,277,027 A * 1/1994 Aoyagi et al. ..... 60/420
6,318,079 B1 * 11/2001 Barber ..... 60/422
6,408,622 B1 * 6/2002 Tsuruga et al. ..... 60/422
6,978,607 B2 * 12/2005 Matsumoto et al. ..... 60/422

* cited by examiner

*Primary Examiner*—Thomas E. Lazo
(74) *Attorney, Agent, or Firm*—Quarles & Brady; George E. Haas

(57) ABSTRACT

A hydraulic system has at least one primary hydraulic functions and a plurality of secondary hydraulic functions all of which are connected in parallel to a supply conduit and a return conduit. A first pressure relief valve prevents pressure in the supply conduit from exceeding a first limit and second pressure relief valve prevents the pressure at the secondary hydraulic functions from exceeding the lower second pressure limit. Novel pressure relief circuits are provided which enable only two pressure relief valves to provide one of two pressure limits at more than two hydraulic functions.

16 Claims, 2 Drawing Sheets

HYDRAULIC SYSTEM WITH MULTIPLE PRESSURE RELIEF LEVELS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems that independently control the operation of a plurality of hydraulic actuators, and more particularly to such hydraulic systems in which various hydraulic actuators have different operating pressure limits as determined by separate pressure relief valves.

2. Description of the Related Art

Numerous types of machines have components that are moved by a hydraulic system. For example, a lift truck is vehicle for transporting objects throughout a factory or warehouse and has an engine which drives a pump to provide pressurized fluid for powering different functions, such as driving wheels to propel the vehicle or lifting the objects.

An exemplary lift truck 10 is shown in FIG. 1 and includes a body 12 with an operator compartment 14. A multiple section, telescopic mast 16 is attached to the front of the body and includes a base section 18 and one or more telescopic sections 20 nested within the base section. A fork carriage 22 with load carrying forks 23 is slidably mounted to one of the telescopic sections and is moved up and down by a lift cylinder 24. Typically the lift cylinder 24 is connected to a mechanism (not shown) comprising chains which pass over pulleys to extend and retract the telescopic sections 20 relative to the base section 18. A tilt cylinder 26, horizontally mounted between the front wheels 25 of the lift truck 10, is attached to the body 12 and the lower end of the mast base section 18. The tilt cylinder 26 pivots the telescopic mast 16 about a horizontal shaft 28 to tilt the ends of the forks 23 up and down to hold the load thereon. The hydraulic fluid that drives the lift and tilt cylinders 24 and 26 is controlled by valves that are operated by controls in the operator compartment 14.

Use of the lift truck 10 often requires that the lift and tilt cylinders 24 and 26 operate in unison to tilt the mast 16 as the fork carriage 22 is being raised. However, each of those functions has a unique pressure characteristic which dictates that its maximum pressure be limited to a different magnitude. Because the fork carriage 22 can carry a relatively heavy load, the maximum pressure limit for the lift cylinder 24 may be 200 bar, whereas the maximum pressure limit for the tilt cylinder is on the order of 140 bar, for example. These maximum pressure levels are determined by the setting of pressure relief valves at various locations in the hydraulic circuit.

Quite often each hydraulic function on a machine had a separate pressure relief valve that was set to a specific pressure limit for the associated function. This type of control was relatively expensive as a pressure relief valve was required for each function even though several of them had the same pressure limit.

U.S. Pat. No. 4,561,463 describes an alternative hydraulic system that has a multiple section valve assembly with a pair of relief valves, one for a single high pressure function and another for two lower pressure functions. A high pressure relief valve governed the pressure at the inlet to the valve assembly and that of the first valve section for the high pressure function. The pressure in the subsequent valve sections was governed by a second relief valve having a lower setting. However, when the second valve section provided pressurized fluid to its associated hydraulic actuator, the third valve section was rendered inoperative. Thus the second and third valve sections were serially connected and all the hydraulic functions could not operate simultaneously.

Therefore, a need still exists to enable three or more hydraulic functions, that require different pressure limits, to operate simultaneously without having to provide a separate pressure relief valve for each function.

SUMMARY OF THE INVENTION

A hydraulic system has a supply conduit that receives fluid under pressure from a source and has a return conduit through which fluid is sent back to the source. A pressure relief passage also is provided. A primary pressure relief valve limits pressure in the supply conduit to less than a first pressure limit.

A first control valve is connected to both the supply conduit and the return conduit and has a first workport for connection to a first hydraulic actuator. In a first position, the first control valve connects the supply to the first workport and in a second position the return conduit is connected to the first workport.

A second control valve is connected to the supply conduit and to the return conduit and has a second workport for connection to a second hydraulic actuator. A first outlet port is coupled to pressure relief passage. The second control valve has a first position in which the supply conduit is connected to the second workport and has a second position in which the return conduit is connected to the second workport.

A third control valve is connected to the supply conduit and the return conduit and has a third workport for connection to a third hydraulic actuator. A second outlet port of the third control valve is coupled to pressure relief passage. The third control valve has a first position in which the supply conduit is connected to the third workport and has a second position in which the return conduit is connected to the third workport, A secondary pressure relief valve connected between the pressure relief passage and the return conduit. The connection and the operation of the secondary pressure relief valve limits both the pressure that the second control valve applies to the second workport and the pressure that the third control valve applies to the third workport to less than a second pressure limit. Typically the first pressure limit is greater than the second pressure limit.

The primary pressure relief valve ensures that the pressure in the hydraulic system never exceeds the first pressure limit and the second pressure relief valve prevents pressure in the hydraulic system from exceeding the second pressure limit when either or both of the second or third hydraulic functions is active.

DETAILED DESCRIPTION OF THE INVENTION

Figure 1:
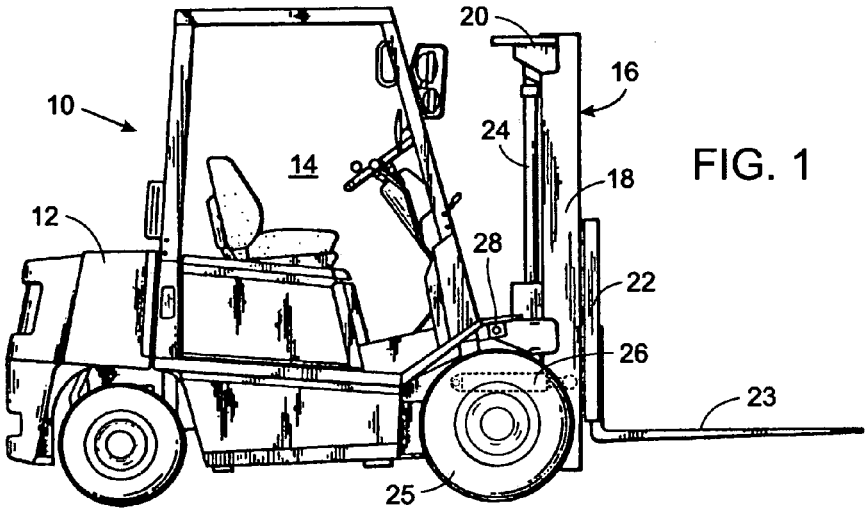
FIG. 1 is a side view of a lift truck that incorporates a hydraulic system according to the present invention.

The present invention will be described in the context of a hydraulic system for a lift truck, such as the one shown in FIG. 1, with the understanding that the inventive concepts can be applied to hydraulic systems for a wide variety of other types of equipment and machines.

Figure 2:
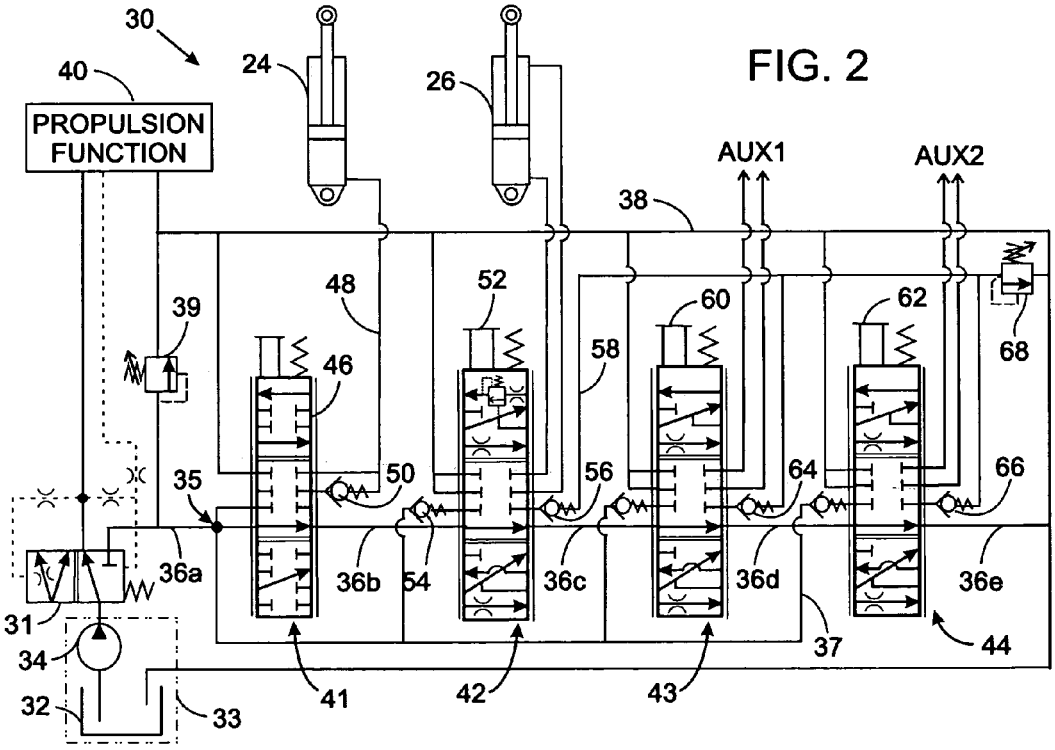
FIG. 2 is a schematic diagram of a version of the hydraulic system that uses open center manually operated valves.

With reference to FIG. 2, the hydraulic system 30 for the lift truck 10 has a source 33 of hydraulic fluid which includes a reservoir 32 from which hydraulic fluid is drawn by a pump 34 and forced under pressure to a pressure control valve 31. The pressure control valve 31 responds to the hydraulic fluid pressure demands of the propulsion function 40 that drives the wheels 25 of the lift truck 10. Typically the vehicle propulsion tales priority over other hydraulic functions, and the pressure control valve ensures that those pressure demands are met to propel the lift truck. Thus the pressure control valve 76 directs the pump output fluid to the propulsion function 40 and any of that output fluid remaining after satisfying the propulsion function is furnished via a supply conduit 35 to the other hydraulic functions 41, 42, and 43.

The supply conduit 35 is divided into a plurality of sections 36*a*-36*e* between those other hydraulic functions 41-43 and into a parallel branch 37. A primary, or first, hydraulic function 41 operates the lift cylinder 24 while the second hydraulic function 42 operates the tilt cylinder 26. The third and fourth hydraulic functions 43 and 44 provide fluid to auxiliary devices connected to the lift truck 10. Hydraulic fluid returns from the hydraulic functions 40-44 to the tank 32 via a return conduit 38.

The pressure in supply conduit 35 is limited to a maximum level by a primary pressure relief valve 39 which opens when the pressure exceeds a level set by an adjustable spring, although other types of relief valves can be employed. In the case of the lift truck 10, the primary pressure relief valve 39 is set to a relatively high pressure level, such as 200 bar, for example. When that pressure limit is exceeded, a path is created through the primary pressure relief valve 39 from the supply conduit 35 to the tank return conduit 38. The relatively high pressure fluid is required by the first hydraulic function 41 in order to raise the fork carriage 22 when carrying a very heavy load.

The first hydraulic function 41 is controlled by a first control valve 46 that is manually operated by a lever within the operator compartment 14 of the lift truck 10. The first control valve 46, as are the control valves for the other hydraulic functions, is a three-position, open-center valve. In the center position, the lift cylinder 24 is disconnected from both the supply conduit 35 and the return conduit 38. However, in this position of the first control valve 46, an open center passage allows hydraulic fluid to flow through the valve between supply conduit sections 36*a* and 36*b*.

When the first control valve 46 is shifted upward in FIG. 2 into an open first position, the first supply conduit section 36*a* is disconnected from the subsequent sections 36*b*-36*e* that are connected to the downstream hydraulic functions 42-44. The first supply conduit section 36*a* is now connected to the workport of the first control valve 46 which is coupled to the head chamber of the lift cylinder 24. It should be noted that pressurized fluid need only be applied to the lift cylinder 24 to raise the fork carriage 22, because gravity provides the force for lowering the fork carriage. As a consequence, a hydraulic connection is not provided to the rod chamber of the lift cylinder 24. A load check valve 50 is connected between the workport of the first control valve 46 and the lift cylinder 24 to prevent an excessive load force from driving hydraulic fluid backwards through the first control valve 46 and into the supply conduit 35.

When the first control valve 46 is shifted into an open second position (downward in the orientation in FIG. 2), the first supply conduit section 36*a* is connected to the next section 36*b* leading to the downstream functions 42-44. In this open position the valve's workport is connected to the return conduit 38 so that fluid can be exhausted from the lift cylinder 24, thereby lowering the fork carriage 22 under the force of gravity.

The second, third and fourth hydraulic functions 42-44 are designated as secondary hydraulic functions because each requires lower pressure hydraulic fluid as compared to the first hydraulic function 41 for the lift cylinder 24. The second hydraulic function 42 operates the tilt cylinder 26 that pivots the mast 16 by means of a second control valve 52, That valve has an inlet port connected the supply conduit branch 37 and another port that is connected to the tank return conduit 38. Note that the tilt cylinder 26 is double acting in that, depending upon the pivoting direction, pressurized fluid is applied to one of the head or rod chambers of that cylinder. Those cylinder chambers are connected to different workports of the second control valve 52.

The second control valve 52 also is a three-position valve having a center-off position with an open center such that in this position supply conduit sections 36*b* and *c* are interconnected while the tilt cylinder 26 is disconnected from both the supply and return conduits 35 and 38. When the second control valve 52 is in a open position in pressurized fluid from the supply conduit branch 37 is fed to one of the chambers of the tilt cylinder 26, and fluid is exhausted from the other cylinder chamber to the return conduit 38. The load check valve 54 for this hydraulic function is located between supply conduit branch 37 and the control valve inlet. Therefore, regardless of which chamber of the tilt cylinder 26 is being powered, the load check valve 54 prevents the backward flow of hydraulic fluid from the cylinder into the supply conduit. In the open positions of the second control valve 52, the pressurized fluid flowing through the valve also is applied via a pressure relief port and check valve 56 to a pressure relief passage 58.

The third and fourth functions 43 and 44 can be utilized to provide fluid to control auxiliary hydraulic devices on the lift truck 10. For example, the fork carriage 22 could be replaced with a work device that requires hydraulic power. Alternatively, a hand tool or other external apparatus can be powered by the lift truck's hydraulic system 30. Each of the third and fourth functions 43 and 44 has a control valve 60 and 62, which are similar in structure to the second control valve 52. Of significance is that the third and fourth control valves 60 and 62 load sense passage have a relief pressure port that is connected by a separate check valve 64 or 66 to the pressure relief passage 58. Thus, the highest pressure among the secondary hydraulic functions 42-44 is conveyed through the respective check valve 56, 64 or 66 into the pressure relief passage 58.

The pressure relief passage 58 is connected by a secondary pressure relief valve 68 to the tank return conduit 38. The secondary pressure relief valve 68 is set to open at a lower pressure level than the primary pressure relief valve 39. As noted previously, the tilt function performed by the tilt cylinder 26, as well as the auxiliary third and fourth functions 43 and 44 require hydraulic fluid at a maximum pressure which is significantly less than the maximum pressure required by the lift cylinder 24 to raise the fork carriage 22 and its load. As a consequence the secondary pressure relief valve 68 has a pressure setting determined by the variable spring which will allow it to open at approximately 140 bar, for example.

The key feature of the configuration of the hydraulic system 30 is that all of the hydraulic function are connected in parallel to the supply and return conduits 35 and 38 and are governed by two pressure limits determined by only a pair of pressure relief valves 39 and 68. When one or more of the secondary hydraulic functions 42-44, is active, even when the first hydraulic function 41 is active, the secondary pressure relief valve 68 limits the maximum supply conduit pressure. When only the primary, or first, hydraulic function 41 is operating, the primary pressure relief valve 39 limits the maximum pressure that may occur in the supply conduit 35. In this latter mode, the control valves 52, 60 and 62 of all the secondary hydraulic functions 42, 43 and 44, respectively, are all in the closed center position in which the pressure relief passage 58 and the secondary pressure relief valve 68 are disconnected from the supply conduit 35. Even when more than one primary hydraulic function is included in the hydraulic system, when only the primary hydraulic functions are active only the primary pressure relief valve 39 governs the supply conduit pressure.

As noted above, when both primary and secondary hydraulic functions are active simultaneously, the hydraulic system defaults to the low pressure limit of the secondary pressure relief valve 68. This may restrict the performance of the primary hydraulic function when higher pressure is required. If the system was configured to default to the higher pressure limit of the primary pressure relief valve 39, the maximum pressure rating of the secondary hydraulic functions could be exceeded, which might result in failure of hydraulic components or structural members of the machine. Regardless of whether the high or low pressure limit is used as the default, when both primary and secondary hydraulic functions operate simultaneously, one type of function can be adversely affected.

Figure 3:
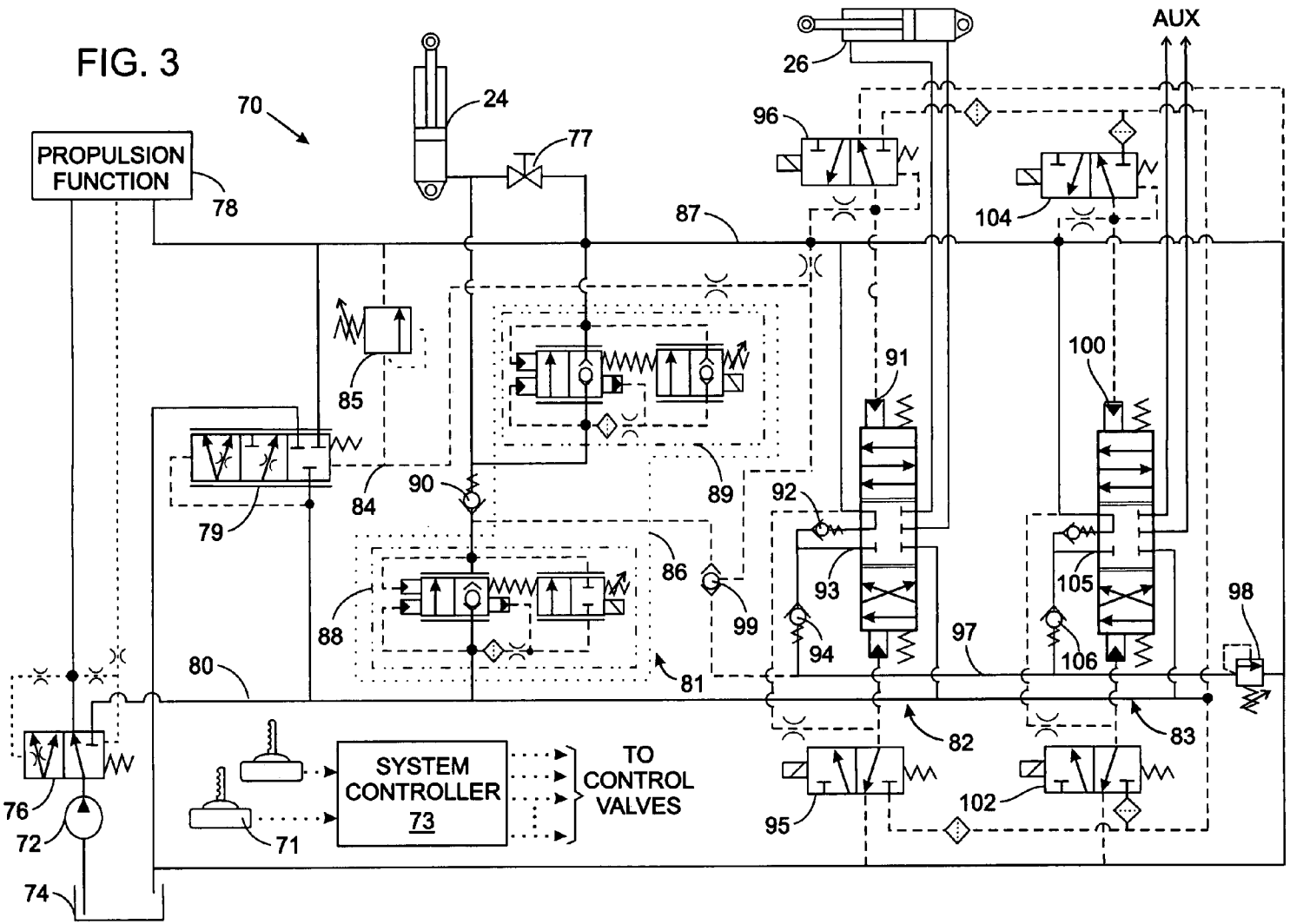
FIG. 3 is a schematic diagram of another version of the hydraulic system that uses electrically operated valves.

That adverse condition can be avoided by employing the second hydraulic system 70 depicted in FIG. 3. This second hydraulic system 70 is based on a present trend toward electrical controls by which the machine operator manipulates a joystick 71 that produces an electrical signal indicating the desired motion for a component of the machine. The joystick signals are applied as inputs to an electronic controller 73 which then produces output signals for activating solenoid operated hydraulic valves that control the flow of fluid to the cylinders 24 and 26 on the lift truck 10.

The second hydraulic system 70 comprises a pump 72 which draws fluid from a tank 74. A pressure control valve 76 responds to the pressure demands of the propulsion function 78 of the lift truck 10 to ensure that those pressure demands are met. Any pump output fluid remaining after satisfying the demands of the propulsion function 78 is furnished via a supply conduit 80 to the other hydraulic functions 81, 82, and 83. On this exemplary machine, there is a single primary hydraulic function 81 which operates the lift cylinder 24 to raise and lower the mast 16, and there are two secondary hydraulic functions 82 and 83. However, other machines may have other numbers of primary and secondary hydraulic functions.

A conventional pressure compensation valve 79 ensures that the pressure within the supply conduit 80 is sufficient to meet the highest pressure demanded by the other hydraulic functions 81, 82 or 83. The pressure compensation valve 79 responds to the difference between the pressure in the supply conduit 80 and in a load sense passage 84 that indicates the greatest pressure demanded by those hydraulic functions. A primary pressure relief valve 85 limits the load sense conduit pressure signal in conduit 84 to a maximum pressure level (e.g. 200 bar) which is the primary pressure setting for the hydraulic circuit.

The first, or primary, hydraulic function 81 controls the operation of the lift cylinder 24 and employs a control valve 86 formed by a pair of proportional, pilot operated poppet valves, such as are described in U.S. Pat. No. 6,745,992. However, it should be understood that other types of valves may be used. The first of these pilot-operated poppet valves 88 is coupled in series with a load check valve 90 between the supply conduit 80 and the head chamber of the lift cylinder 24. As with the previous hydraulic circuit, pressurized fluid is only applied to the head chamber of the lift cylinder 24 because the force of gravity is used to lower the mast 16. The second pilot-operated poppet valve 89 is coupled between the lift cylinder 24 and a return conduit 87 which leads to the tank 74. Because this system is electrically controlled, a manual valve 77 is provided between the lift cylinder 24 and the tank return conduit 87 as a safety measure to lower the mast 16 when electrical power is unavailable to operate the hydraulic system.

Hydraulic system 70 has two secondary functions 82 and 83. The second hydraulic function 82 controls the tilt cylinder 26 on the lift truck 10 and employs a second control valve 91 having a spool that is operated by the hydraulic pressure at each end. Those pressures are controlled by a pair of solenoid valves 95 and 96. Applying pressurized fluid to one end of the second control valve spool and relieving the pressure at the opposite end to the return conduit 87 moves the spool into one of two open states, thereby sending fluid from the supply conduit 80 to one chamber of the tilt cylinder 26 and exhausting fluid from the other chamber to the return conduit. A conventional load check valve 92 prevents the flow of fluid backward from the tilt cylinder 26 to the supply conduit 80.

The third function 83 is similar to the second function and is provided to power an auxiliary device on the lift truck 10. The third function 83 has a third control valve 100 with a spool that moves in response to pressure applied to its ends by a pair of solenoid valves 102 and 104.

The second control valve 91 has a port 93 that is coupled by a check valve 94 to a pressure relief passage 97 and the third control valve 100 has a port that is connected by a check valve 106 to the relief pressure passage. The pressure relief passage 97 is coupled by a secondary pressure relief valve 98 to the tank return conduit 87. In addition, the pressure relief passage 97 is connected to one input of a conventional load sense shuttle valve 99. The other input of the load sense shuttle valve 99 is connected to the outlet of the first control valve 88 for the primary hydraulic function 81. The output pressure of the load sense shuttle valve 99 corresponds to the greater load pressure from either the first hydraulic function 81 or the pressure relief passage 97 which carries the greater load pressure from the second and third hydraulic functions 82 and 83. The output pressure of the load sense shuttle valve 99 is applied via a load sense passage 84 to the pressure compensation valve 79.

When only the secondary functions are active, the pressure from the pressure relief passage 97 is conveyed by the load sense shuttle valve 99 through the load sense passage 84 to the pressure compensation valve 79. That pressure from the secondary functions controls operation of the pressure compensation valve 79, thereby governing the pressure in the supply conduit 80. Specifically, supply conduit pressure is equal to the load sense passage plus a margin established by the pressure compensation valve. When only the primary function 81 is active, its load pressure is applied through the load sense shuttle valve 99 and the load sense passage 84 to the pressure compensation valve 79. In situations where both the primary and secondary functions are active, the greatest load pressure from among them is conveyed by the load sense shuttle valve 99 and the load sense passage 84 to the pressure compensation valve 79 for governing the pressure in the supply passage.

The primary and secondary pressure relief valves 85 and 98 independently limit the maximum pressure that is applied to the primary and secondary hydraulic functions, respectively. The output pressures of the secondary hydraulic functions 82 and 83 are conveyed from the respective port 93 or 105 of the second and third control valves 91 and 100 into the pressure relief passage 97. If both secondary hydraulic functions are simultaneously active only the greater output pressure is passed by the check valves 94 and 96 into the pressure relief passage 97. When the pressure relief passage pressure exceeds the setting of the secondary pressure relief valve 98 that valve opens releasing the pressure to the return conduit 87, thereby limiting the maximum output pressure of the secondary hydraulic functions 82 and 83.

The primary pressure relief valve 85 prevents the output pressure of the first, or primary, hydraulic function 81 from exceeding its maximum permitted limit. Because the maximum permitted pressure at the first hydraulic function 81 is greater that the maximum pressure allowed at the secondary functions 82 or 83, that maximum load pressure will be conveyed through the shuttle valve 99 and the load sense passage 84 to the primary pressure relief valve 86. That relief valve opens when its pressure setting is exceeded, thereby releasing the pressure to the return conduit 87. This limits the pressure in the load sense passage 84 that in turn controls the operation of the conventional pressure compensation valve 79 to limit pressure which can occur in the supply conduit 80. The shuttle valve 99 blocks the output pressure of the first hydraulic function 81 from reaching the secondary pressure relief valve 98. Therefore the secondary pressure relief valve 98 governs only the secondary hydraulic functions 82 and 83 and the primary pressure relief valve 86 effectively governs only the primary hydraulic function 81.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A hydraulic system comprising:

a supply conduit receiving fluid under pressure from a source;

a return conduit for conveying fluid back to the source;

a pressure relief passage;

a first control valve connected to the supply conduit and the return conduit and having a first workport for connection to a first hydraulic actuator, wherein the first control valve has a first position in which the supply conduit is connected to the first workport and a second position in which the return conduit is connected to the first workport;

a primary pressure relief valve limiting pressure in the supply conduit to less than a first pressure limit;

a second control valve connected to the supply conduit and the return conduit and having a second workport for connection to a second hydraulic actuator, wherein the second control valve has a first position in which the supply conduit is connected to the second workport and a second position in which the return conduit is connected to the second workport, the second control valve having a first outlet port coupled to the pressure relief passage;

a third control valve connected to the supply conduit and the return conduit and having a third workport for connection to a second hydraulic actuator, wherein the third control valve has a first position in which the supply conduit is connected to the third workport and a second position in which the return conduit is connected to the third workport, the third control valve having a second outlet port coupled to the pressure relief passage; and a secondary pressure relief valve connected to the pressure relief passage and limiting pressure that the second control valve applies to the second workport and the third control valve applies to the third workport to less than a second pressure limit.

2. The hydraulic system as recited in claim 1 wherein the first pressure limit is greater than the second pressure limit.

3. The hydraulic system as recited in claim 1 wherein the primary pressure relief valve is connected between the supply conduit and the return conduit.

4. The hydraulic system as recited in claim 1 further comprising:

a load sense circuit that produces a pressure signal indicating a greatest load pressure among the first, second and third control valves; and a pressure compensation valve responsive to the pressure signal for limiting pressure in the supply conduit to a defined level.

5. The hydraulic system as recited in claim 4 wherein the primary pressure relief valve is connected between the load sense circuit and the return conduit, and limits the pressure signal to a defined level.

6. The hydraulic system as recited in claim 1 wherein the secondary pressure relief valve couples the pressure relief passage to the return conduit.

7. The hydraulic system as recited in claim 1 further comprising a first check valve coupling the first outlet port of the second control valve to the pressure relief passage; and a second check valve coupling the second outlet port of the third control valve to the pressure relief passage; wherein the first and second check valves prevent fluid flow from the pressure relief passage into the second and third control valves.

8. A hydraulic system comprising:

a supply conduit receiving fluid under pressure from a source;

a return conduit for conveying fluid back to the source;

a first hydraulic function having a first hydraulic actuator that receives fluid from the supply conduit and exhausts fluid into the return conduit, wherein a load pressure is produced by force acting on the first hydraulic actuator;

a second hydraulic function having a second hydraulic actuator that receives fluid from the supply conduit and exhausts fluid into the return conduit, wherein a second load pressure is produced by force acting on the second hydraulic actuator;

a third hydraulic function having a third hydraulic actuator that receives fluid from the supply conduit and exhausts fluid into the return conduit, wherein a third load pressure is produced by force acting on the third hydraulic actuator;

a pressure relief passage connected to the second hydraulic function and the third hydraulic function and isolated from the first hydraulic function, and receiving a greater of a second load pressure and a third load pressure;

a primary pressure relief valve limiting pressure in the supply conduit to less than a first pressure limit;

a secondary pressure relief valve connected between the pressure relief passage and the return conduit and limiting pressure in the second hydraulic function and the third hydraulic function to less than a second pressure limit.

9. The hydraulic system as recited in claim 8 wherein the first pressure limit is greater than the second pressure limit.

10. The hydraulic system as recited in claim 8 further comprising:

a load sense circuit that produces a pressure signal indicating a greatest load pressure among the first, second and third hydraulic functions; and a pressure compensation valve responsive to the pressure signal for limiting pressure in the supply conduit to a defined level.

11. The hydraulic system as recited in claim 10 further comprising a first check valve coupling the second hydraulic function to the pressure relief passage; and a second check valve coupling the third hydraulic function to the pressure relief passage, wherein the first and second check valves convey whichever of the second and third load pressures is greatest to the pressure relief passage.

12. A hydraulic system comprising:

a supply conduit receiving fluid under pressure from a source;

a return conduit for conveying fluid back to the source;

a pressure relief passage;

a first control valve connected to the supply conduit and the return conduit and including a first workport for connection to a first hydraulic actuator, and further having a first position in which the supply conduit is connected to the first workport and a second position in which the return conduit is connected to the first workport;

a second control valve connected to the supply conduit and the return conduit and including a second workport for connection to a second hydraulic actuator, and further having a first position in which the supply conduit is connected to the second workport and a second position in which the return conduit is connected to the second workport, the second control valve including a first outlet port coupled to the pressure relief passage;

a third control valve connected to the supply conduit and the return conduit and including a third workport for connection to a second hydraulic actuator, and further having a first position in which the supply conduit is connected to the third workport and a second position in which the return conduit is connected to the third workport, the third control valve including a second outlet port coupled to the pressure relief passage;

a load sense circuit that produces a pressure signal indicating a greatest load pressure among the first, second and third control valves;

a pressure compensation valve responsive to the pressure signal for limiting pressure in the supply conduit to a defined level;

a primary pressure relief valve connected between the load sense circuit and the return conduit, and limiting the pressure signal to a defined level; and a secondary pressure relief valve connected to the pressure relief passage and limiting pressure that the second control valve applies to the second workport and the third control valve applies to the third workport to less than a second pressure limit.

13. The hydraulic system as recited in claim 12 wherein the secondary pressure relief valve couples the pressure relief passage to the return conduit.

14. The hydraulic system as recited in claim 12 wherein the first pressure limit is greater than the second pressure limit.

15. The hydraulic system as recited in claim 12 further comprising a first check valve coupling the first outlet port of the second control valve to the pressure relief passage; and a second check valve coupling the second outlet port of the third control valve to the pressure relief passage; wherein the first and second check valves prevent fluid flow from the pressure relief passage into the second and third control valves.

16. The hydraulic system as recited in claim 12 wherein load sense circuit comprises a shuttle valve having one input connected to the pressure relief passage and another input connected to the first control valve, and an output at which the pressure signal is produced and coupled to the pressure compensation valve.

* * * * *